United States Patent [19]

Bullington

[11] 4,253,227

[45] Mar. 3, 1981

[54] STRAP SECURING METHOD

[75] Inventor: Robert E. Bullington, Bear, Del.

[73] Assignee: Cyklop Strapping Corporation, Philadelphia, Pa.

[21] Appl. No.: 97,475

[22] Filed: Nov. 26, 1979

[51] Int. Cl.[3] ..... B23P 3/00; B23P 25/00

[52] U.S. Cl. ..... 29/458; 29/469.5; 29/509; 29/243.56; 24/23 W; 81/9.1 R

[58] Field of Search ..... 29/509, 469.5, 243.56, 29/243.57, 460, 458; 81/9.1 R; 24/23 W, 23 R; 140/93.4

[56] References Cited

U.S. PATENT DOCUMENTS

| | | | |
|---|---|---|---|
| 1,252,680 | 1/1918 | Flora | 24/23 W |
| 1,445,330 | 2/1923 | Leslie | 24/23 W |
| 1,483,714 | 2/1924 | Brooks | 24/23 W UX |
| 1,502,458 | 7/1924 | Brooks | 24/23 W |
| 1,991,215 | 2/1935 | Horvath | 24/23 W |
| 2,062,099 | 11/1936 | MacChesney | 24/23 W |
| 2,356,059 | 8/1944 | Humphner | 24/23 W |
| 2,662,431 | 12/1953 | Childress | 81/9.1 R |
| 2,710,435 | 6/1955 | Crosby | 24/23 W |
| 3,267,535 | 8/1966 | Martin et al. | 24/23 W UX |
| 3,550,647 | 12/1970 | Beach | 140/93.4 |

*Primary Examiner*—Charlie T. Moon
*Attorney, Agent, or Firm*—Eugene G. Horsky

[57] ABSTRACT

An improved method and apparatus, and a new metal seal for use in securing overlying portions of generally flat, non-metallic strap with little or no strap bulging under applied seal-closing forces and with a firm interlock between the applied seal and embraced strap portions.

12 Claims, 13 Drawing Figures

STRAP SECURING METHOD

The present invention is directed to an improved method and apparatus for securing overlying portions of non-metallic strap, and to a new seal which is adapted for use with such method and apparatus.

In general, seals presently employed in securing overlying portions of non-metallic strap are essentially the same as those which have long been used with metal strap. A typical seal of such known seals simply consists of sheet steel pressed into a channel shape, having a web and outstanding flanges, which is embraced about overlying strap portions by engaging the web thereof with the strap portions and folding the seal flanges into abutting or overlapping relationship. A secure interlock between the seal and the embraced strap portions is essential, and while slitting tongues in an applied seal and strap portion, as described in U.S. Pat. Nos. 1,252,680 and 2,062,099, or the use of abrasive grit between such seal and strap portions may be satisfactorily employed with metal strap, such means are not applicable for use with non-metallic strap.

More specifically, commercially available plastic strap, such as strap formed of polypropylene, polyester, nylon, and similar polymeric resins, possesses a predominantly longitudinal molecular orientation which is necessary to satisfy tensile strength requirements. Such plastic strap generally exhibits a tendency to split longitudinally and/or a sensitivity to edge nicks at which tearing may start. Thus, with conventional seals, securing of plastic strap without impairing its integrity at or adjacent to the sealed areas is difficult to achieve, particularly with satisfactory consistency. Moreover, in view of the lubricity of plastic strap, slip-failure of conventional seals is much too often encountered.

Similar difficulties arise in the use of conventional seals with flat strap formed of cords, such as rayon and polyester, retained in side-by-side relationship by a binder. Here again strap integrity must be maintained in the area of seal application, and the cord binder generally offers little in the way of an interlock between the seal and strap.

Recognizing the unique characteristics of non-metallic strap, various proposals have been made for overcoming the difficulties encountered when such strap is secured with conventional seals. For example, U.S. Pat. Nos. 3,261,063 and 3,636,592 describe seals having sharp ridges or teeth which are capable of biting into non-metallic strap during seal application, while U.S. Pat. No. 3,237,255 describes the crimping of a seal and embraced strap portions to interlock the same. These and other known proposals generally provide for limited improvement and may well aggravate the difficulties which result when conventional seals are used. Accordingly, a primary object of this invention is an improved method and apparatus for securing overlying portions of non-metallic strap with metal seals, and to a new seal which is applicable for use in such method and with such apparatus.

Another object of this invention is an improved method and apparatus for securing overlying portions of non-metallic strap by means of a metallic seal in which the strap portions themselves assist in controlling seal deformation during the application thereof.

Still another object of this invention is an improved method and apparatus for use in securing overlying portions of non-metallic strap with a metal seal in a manner as to at least minimize transverse distortion of the strap portions during seal application.

A further object is the provision of an improved method and apparatus which provide for a firm interlock between a metal seal and embraced overlying portions of non-metallic strap without appreciable damage to the strap portions.

A still further object of this invention is a metallic seal having a preformed configuration which permits overlying portions of non-metallic strap to flex into a contour during seal application such that distortion of the strap portions is minimized and a highly effective interlock between the applied seal and strap portions is provided.

These and other objects of this invention are achieved by an improved method and apparatus which accommodate and effectively utilize the reactions of overlying portions of non-metallic strap during the application of an embracing metallic seal thereto.

More specifically, in known methods for securing overlying portions of generally flat, non-metallic strap by a metallic seal having a flat web and flanges, forces are applied to the seal web and flanges to fold the seal flanges in the area of the seal corners and onto the overlying strap portion and, also to crimp the seal and the contained strap portions in a transverse direction thereof.

The method of the present invention is predicated upon the discoveries that, with conventional methods, opposing component forces which are applied and serve to fold the seal flanges compress the seal in its transverse direction, causing flange folding to occur along axes which tend to progressively shift away from the original seal corners and along the seal web. The seal width is thereby progressively reduced and, with the continued application of the opposing component forces, the overlying strap portions that are within the seal are subjected to increasing compression in the transverse direction thereof. These overlying strap portions react to such transverse compression by bulging in between the seal flanges and, as minimal resistance is offered to this reaction, the overlying strap portions continue to bulge away from the seal web with the continued application of the opposing component forces and the progressive reduction in the seal width. As a result, the bulged sections of the overlying strap portions may well be weakened, may interfere with the desired crimping of the seal, and/or perhaps inhibit complete folding of the seal flanges or possibly encourage the applied seal to open when the secured strap is subjected to increased or shock tensions.

In the method of this invention, opposing component forces which are applied to the flanges of a seal also tend to reduce the seal width and to compress the overlying strap portions which are within such seal in the transverse direction thereof. However, as distinguished from the effects which arise in the conventional procedure described above, in the method of this invention the reduction in the seal width is manifested by a controlled or limited bowing of the seal back away from the seal flanges and, as the longitudinal edges of the overlying strap portions are snugly seated within the seal corners, is accompanied by a similar bowing of such overlying strap portion. As the seal web bows during the initial application of the opposing component forces and bows only to a limited extent, and as the bowed overlying strap portions are supported or reinforced by the bowed web, during the continued application of the opposing component forces, the longitudinal edges thereof serve as fulcrums about which subsequent flange folding occurs under the applied opposing component forces. Moreover, as the longitudinal edges of the overlying strap portions remain seated within the seal corners, such strap portions are firmly interlocked with the seal during the crimping thereof.

Desirably, the seal web is caused to bow into a contour such that the overlying portions of non-metallic strap which are being secured are flexed toward the bowed web under and to at least partially accommodate the opposing component forces which are applied to the seal flanges. In this manner, the tendency for the overlying strap portions to bulge toward the seal flanges during continued flange folding is certainly minimized, if not eliminated. Preferably, the seal web is caused to bow into a smooth arcuate contour which extends between the corner areas of the seal, and certainly one which is of less concavity than that which would provide for seal bending at locations other than predominantly at the corners thereof under the applied opposing component forces.

By the method of this invention, the seal and the overlying strap portions are crimped from each of the opposite longitudinal edges of the seal along at least about $\frac{1}{3}$ of the seal width. This is achieved by applying forces to the seal web and flanges, preferably with the magnitude of such forces varying across the seal width so that the crimps are of less depth progressively along the lengths thereof from a maximum depth along the longitudinal edges of the seal.

Of particular significance, as the method of this invention at least minimizes bulging of the overlying strap portions toward or outwardly from between the seal flanges and provides for snug seating of the longitudinal edges of the such strap portions, the transverse crimps firmly interlock the seal and overlying strap portions, with such interlock being most effective along areas of the seal extending across about $\frac{1}{3}$ of the seal from each of its opposite longitudinal edges. As an illustration of the firm interlock, strap connections achieved with seals applied by the method of this invention suffer little loss in strength when the central portion of the seal web, equal to about $\frac{1}{3}$ of the seal width, and corresponding portions of the seal flanges are removed.

Thus, by the method of this invention, the continuity and integrity of the central portion of the non-metallic strap is maintained within the seal, seal closing or lower crimping forces may be employed since the crimps need not extend across the entire width of the seal and, as with butt-type seals the free edge portions of the seal flanges may remain uncrimped, the tendency for seals to open under increased strap tension is significantly reduced.

As with conventional apparatus, the apparatus of this invention includes a pair of jaws disposed between and movable relative to a pair of anvil plates. More specifically, both such apparatus have a series of parallel, spaced anvil plates with a pair of jaws pivotally mounted between adjacent of such anvil plates. The jaws move in unison, with free ends of the jaws of each respective pair moving between an open position, in which edges on the anvil plates and the jaws are spaced apart and adapted to engage with the web and flanges of a seal, and a closed position, in which the seal flanges are folded at the seal corner areas thereof onto overlying strap portions and the seal is crimped in the transverse direction thereof.

In the apparatus of this invention, however, edge surfaces on the anvil plates define a trough in each of the anvil plates, with all of such troughs being aligned and of essentially like concavity so as to permit and limit bowing of the seal web away from the seal flanges under opposing component forces applied to such flanges by the pairs of jaws. The concavity of the anvil plate troughs is such that, concomitantly with and/or subsequent to bowing of the seal web, longitudinal edges of the overlying strap portions are seated snugly within the seal corners and such overlying portions are bowed or flexed into substantial conformity with the bowed web of the seal during the application of the opposing component forces. Preferably, the concavity of the anvil plate troughs is such as to receive a seal having a web bow which extends between corner areas of the seal so to accommodate some of the opposing component forces applied to the seal flanges, yet permit some additional bowing of the seal web, if so desired, under the opposing component forces. The concavity of the anvil plate troughs must be less than that which would facilitate bending of the flanges at locations other than predominantly at the seal corners.

The edge surfaces on the anvil plates and jaws are flat and are arranged to effect crimping of the seal from its opposite longitudinal edges along at least about $\frac{1}{3}$, and preferably less than about $\frac{1}{2}$, of the seal width when the jaws are in their fully closed positions, with each such crimp being of less depth progressively along its length from its maximum at the seal edges. The sides of the anvil plates and jaws are bevelled directly adjacent to the respective edge surfaces thereof and define corners with such respective edge surfaces.

Desirably, the force applied to the apparatus to move the jaws into a closed position during use of this apparatus should not exceed about 45 pounds and can be controlled to some degree by the bevel along the sides of the anvil plates and/or jaws. Yet, in the apparatus of this invention it is preferred that the edge surfaces on the anvil plates and jaws be of sufficient width to impose maximum compression on the overlying strap portions generally along lines extending between the corners of adjacent anvil plates and jaws during seal crimping. This effect is particularly significant when applying a seal to plastic strap since plastic flow occurs at the locations at which the overlying strap portions are subjected to maximum compression and thereby enhances the mechanical interlock between the seal and the strap portions.

The method and apparatus of this invention are applicable for use with conventional metal seals having a web and flanges, the latter of which may be disposed along parallel, diverging or converging planes and adapted to be folded into overlapping or abutting relationship. Yet, for the sake of ease of operation and improved consistency in providing highly reliable strap connections, seals preformed with bowed webs are preferred. The bowing of such seal web is equal to or slightly less than that which is achieved during the practice of the described method of this invention and, desirably, is of smooth arcuate contour. The inside width of such preformed seal is at least equal to or only slightly greater than the width of the non-metallic strap to which it is to be applied so that very little additional curvature need be imparted to the seal web to snugly seat the longitudinal edges of the overlying strap portions in the seal corners.

To assist in this snug seating of the longitudinal edges of the strap portions, and to facilitate retention of the preformed seal during its initial positioning on the overlying strap portion, the flanges are disposed along converging planes, with each flange forming a corner with the seal web having a radius of from about 1 to 2 times the thickness of the strap which is to be sealed. At their free ends, the flanges are, of course, spaced apart sufficiently to permit the seal to be cocked onto overlying strap positions.

While the preformed seals, as well as conventional seals used in the described method, may be formed of any suitable metal, electrogalvanized sheet steel is preferred, based upon the discovery that, upon the application of such seals to plastic strap, and particularly polyester strap, by the method of the invention, the seal webs bond to the strap surfaces engaged therewith. The seal thickness can be varied to suit particular requirements. Preferably, the seals are formed of sheet metal having a thickness not less than about 0.030 inch for satisfactory rigidity and not greater than about 0.040 inch to avoid the need for jaw closing forces in excess of the desired 45 pounds. Seals fabricated from electrogalvanized sheet steel having a thickness of about 0.036 inch satisfy these criteria very well.

For the sake of simplicity, the invention is hereafter described with butt-type seals; that is, seals in which the free edges of the flanges thereof are in generally opposing relationship upon completion of seal application to overlying strap portions. Further, while the apparatus is hereafter described as a manually-operated tool, the teachings of such apparatus are also applicable for use machines.

Figure 1:
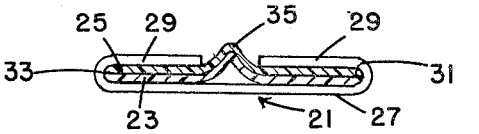
FIG. 1 is a section taken transversely through overlying strap portions adjacent to an embracing seal applied by conventional procedures.

FIG. 1 illustrates the typical result obtained when a conventional metal seal 21 is applied about overlying portions 23 and 25 of flat, non-metallic strap, especially plastic strap, by known procedures. The applied seal 21 includes a web 27, flanges 29, and corners 31 within which the longitudinal edges 33 of the strap portions 23 and 25 are snugly seated. However, as heretofore described, during seal application by known procedures, the seal is reduced in width and the overlying strap portions within such seal are subjected to substantial compression in the transverse direction thereof. As a result, and as indicated at 35 in FIG. 1, the overlying strap portions 23 and 25 bulge away from the seal web 27 and in between the flanges 29 and may well inhibit the desired folding of the seal flanges 29, encourage opening of the seal 21 when the strap portions are subjected to shock tensions and, in the case of molecularly oriented plastic strap, cause longitudinal splitting thereof.

Figure 2:
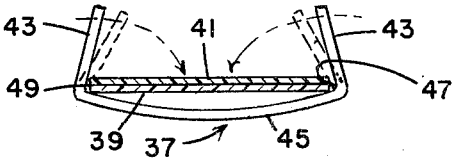
FIGS. 2, 3 and 4 are views similar to FIG. 1 illustrating different stages of seal application in accordance with the method of the present invention.
Figure 3:
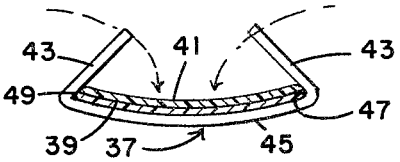
Figure 10:
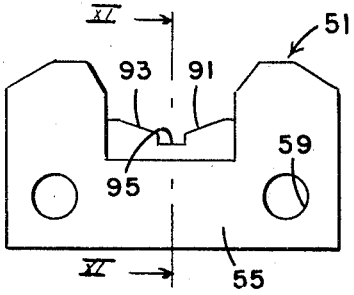
FIG. 10 is a side view of an anvil plate of the apparatus shown in FIGS. 8 and 9.
Figure 4:
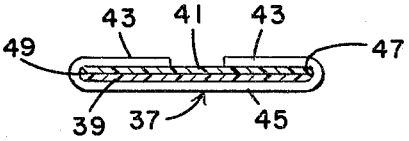

Shown in FIGS. 2–4 is a preformed seal 37 of the present invention as applied to overlying strap portions 39 and 41 in accordance with the method of this invention. For simplicity of description the strap portions 39 and 41 are hereafter referred to as overlying ends of a plastic strap, such as one which has been encircled about and tensioned onto an article or package. Further, it will be understood the conventional seals may be used in place of the preformed seal 37 without changing the method or otherwise departing from the teachings of this invention.

The preformed seal 37 includes flanges 43 and a bowed web 45 which, with the flanges 43 defines seal corners 47. Upon application of forces to the flanges 43 to effect folding of the same, as by the apparatus shown in FIGS. 8–13 and hereafter described in detail, opposing components of such forces initially serve to seat the longitudinal edges 49 of the strap ends 39 and 41 snugly within the seal corners 47.

Concomitantly with the seating of the edges 49 of the strap ends and/or with the continued application of the opposing component forces to the seal flanges 43, the overlying strap portions 39 and 41 are flexed toward and into snug engagement with the seal web 45 under such applied forces as shown in FIG. 3. Of particular significance is that, once the strap ends are flexed against the bowed web 45 of the seal 37, the seal web 45 supports or reinforces the flexed overlying strap portions. Thus, as the longitudinal edges 49 of such strap ends 39 and 41 are seated snugly within the seal corners 47, they now serve as fulcrums about which the seal flanges 43 pivot or fold under the applied opposing component forces. While these opposing component forces, of course, cause the seal flanges 43 to fold toward the overlying strap ends 39 and 41, the concomitant flexing of the overlying strap portions 39 and 41 not only enables the longitudinal edge portions 49 thereof to function as fulcrums, but serves also to accommodate or assist in dissipating these opposing component forces. Thus, opposing forces acting transversely on the overlying strap portions 39 and 41, or the tendency for such strap portions to buckle upwardly or away from the seal web, are at least minimized.

Figure 5:
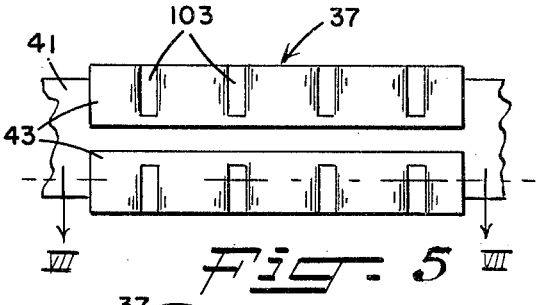
FIGS. 5 and 6 are top and bottom views of the seal and strap portions shown in FIG. 4.
Figure 13:
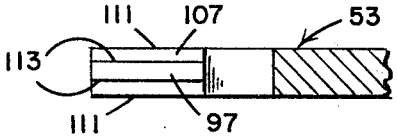
FIG. 13 illustrates a fragmentary portion of a sealing jaw of the apparatus as viewed along the line XIII—XIII of FIG. 9.
Figure 6:
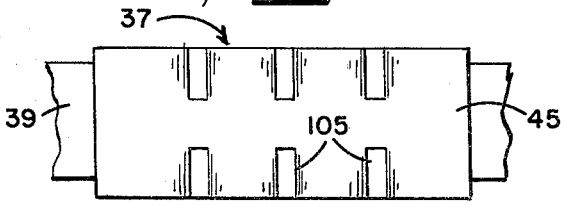

With the seal flanges 43 now in positions as, for example, shown in FIG. 3, and with the continued application of closing forces to such flanges 43, the components acting vertically on the flanges 43, as viewed in FIG. 3, are now more pronounced and serve to complete the flange folding and to effect crimping of the seal 37, as seen in FIGS. 5 and 6.

Figure 9:
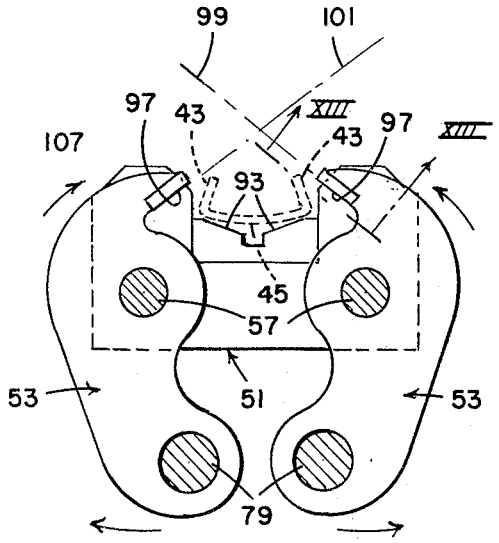
FIG. 9 is a view taken transversely of the apparatus of this invention.
Figure 7:
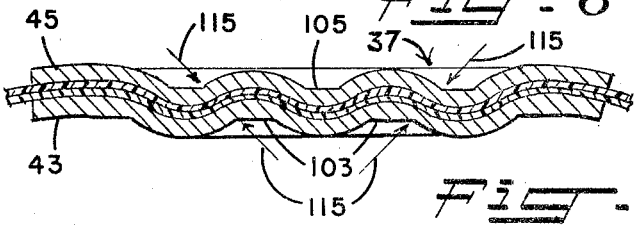
FIG. 7 is a section taken along the line VII—VII of FIG. 5.
Figure 8:
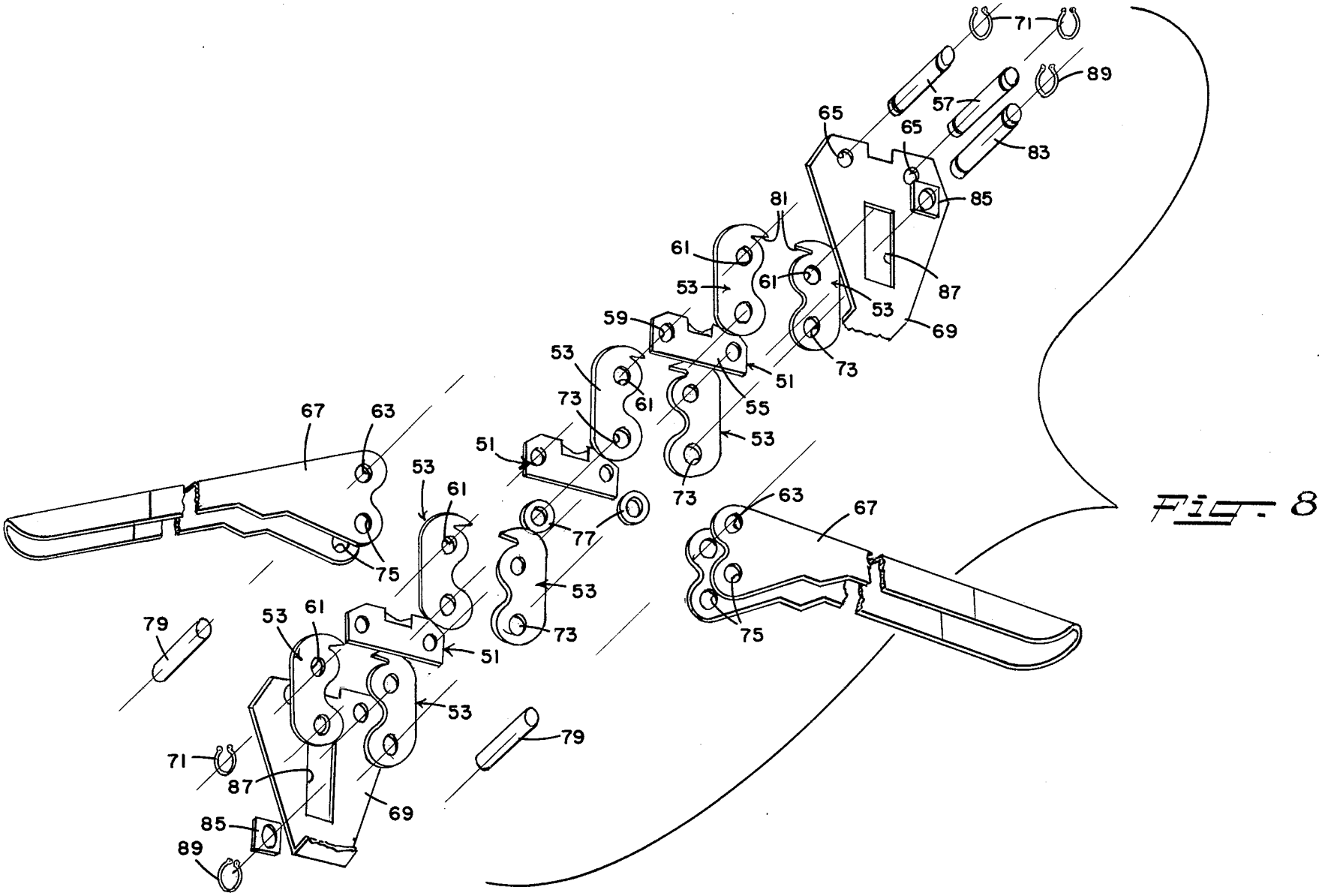
FIG. 8 is an exploded view of the apparatus of this invention.

As a further and complete understanding of the advantages of the applied seal shown in FIGS. 5–7 is afforded by a description of the apparatus of this invention, reference is now made to FIGS. 8 and 9 which illustrate a series of spaced, parallel anvil plates 51 and jaws 53 disposed in pairs between adjacent sides 55 of the anvil plates 51. Pivot pins 57 extend through openings 59 and 61 in the anvil plates 51 and jaws 53, as well as through openings 63 and 65 in operating handles 67 and flanges 69 of an integral cover member, respectively, and are locked against longitudinal movement by spring retainers 71. The jaws 53 and the operating handles 67 also have openings 73 and 75, respectively, which, together with spacers 77, receive pins 79, whereby movement of the handles 67 will cause the free ends 81 of the jaws 53 of each such pair of jaws toward and away from each other. A center pin 83 has guide nuts 85 at its opposite ends which ride within slots 87 formed in the end plates 69. Spring retainers 89 lock the guide pin 83 against longitudinal movement.

The apparatus of FIG. 8 thus far described is the same as those known in the art. However, it will be noted from FIG. 8, and still better in FIGS. 9 and 10, that the anvil plates 51 are each formed with a trough 91, the flat edge surfaces 93 of which serve to permit and limit bowing of the seal web 45. These trough edge surfaces 93 may be of smooth arcuate contour, or in the form of a series of flat surfaces defining a concave contour or, as illustrated, be along converging planes which intersect within a channel 95 that serves only to simplify machining of such surfaces 93.

The apparatus of this invention also differs from those known in the art in the construction of the jaws 53. More specifically, in the open position of the jaws 53, as shown in FIG. 9, the edge surfaces 97 of each pair of cooperating jaws lie along planes, as indicated at 99 and 101, which define an included angle which is less than that present in known apparatus. While the angular relationship of the jaw edge surfaces 97 may be varied within certain limits, it is necessary that these edge surfaces 97 be disposed so as to impress crimps in the seal flanges which extend across about $\frac{1}{3}$, and preferably less than about $\frac{1}{2}$, of the seal width from opposite longitudinal edges of the seal, as indicated at 103 in FIG. 5. During the closing of the jaws 53, the edge surfaces 93 of the anvil plates 51 will, of course, also impress crimps in the seal web, as indicated at 105 in FIG. 6 which are similar to the crimps 103.

Thus, as the included angle between the surfaces 97 of the jaws 53 in their open position is less than that existing in conventional apparatus, the lengths of the crimps 103 and 105 impressed in the seal will be shorter in length than those provided by known apparatus. Moreover, the crimps 103 and 105 are of less depth progressively along the lengths thereof from a maximum depth along the seal edges. Contrary to what is generally assumed by those in the art, the shorter crimps 103 and 105 provided by the apparatus of this invention are of advantage in that lower jaw closing forces are required, the crimps are located only along those portions of the seal in which the interlock between the seal and overlying strap portions is most effective, and at most, minimal damage to the strap portions results.

Figure 11:
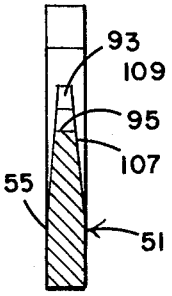
FIG. 11 is a section taken along the line XI—XI of FIG. 10.
Figure 12:
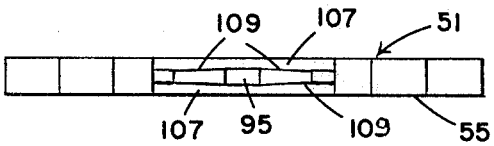
FIG. 12 is a top view of the anvil plate shown in FIG. 10.

As seen in FIGS. 11 and 12 the sides 55 of the anvil plates 51 are bevelled at 107 and form relatively sharp corners 109 with the trough or anvil plate edge surfaces 93. Similarly, the sides 111 of the jaws 53 are bevelled at 107 and form relatively sharp corners 113 with the jaw edge surfaces 97. The bevelling 107 of the anvil plates 51 and jaws 53 also serves to keep the required jaw closing force to a minimum.

Of significance in the apparatus of this invention is that the jaw edge surfaces 97 are substantially wider than corresponding surfaces of known apparatus. This result is achieved by having the edge surfaces 97 of each pair of cooperating jaws 53 arranged to extend along planes 99 and 101, as heretofore described, and by the degree to which the sides 111 of such jaws 53 are bevelled.

It has been discovered that by this increase in the width of the jaw edge surfaces 97, during crimping the overlying strap portions 39 and 41 are subjected to maximum compression along lines which extend generally between the adjacent anvil plate and jaw corners 109 and 113, as indicated by arrows 115 in FIG. 7. Such compression of the plastic strap results in an actual flow of the strap material which further enhances the mechanical interlock between the seal 37 and strap portions 39 and 41.

I claim:

1. In a method wherein overlying portions of generally flat, non-metallic strap are secured by a metallic seal having a web and flanges, said method including the steps of applying forces to the seal web and flanges to fold the flanges at the seal corners onto overlying strap portions and to crimp the seal in a transverse direction thereof, the improvement comprising causing the overlying strap portions and the seal web to assume a similar bow away from the seal flanges under opposing component forces applied to the seal flanges to seat longitudinal edges of the overlying strap portions snugly within the seal corners, whereby such seated strap portions serve as fulcrums about which the seal flanges are folded during the continued application of the opposing component forces and are firmly interlocked with the seal during crimping.

2. A method as defined in claim 1 wherein the improvement comprises causing the overlying strap portions to flex generally along the entire transverse dimensions thereof in the direction of the seal web and into snug engagement with the bowed web so as to be supported thereby during the continued application of the opposing component forces.

3. In a method as defined in claim 1 wherein the improvement further comprising causing the seal web to bow to a degree less than that which provides for seal bending at a location other than predominately at the corner areas thereof under the applied opposing component forces.

4. In a method as defined in claim 1 wherein the improvement comprises applying said forces to a seal preformed with a web bowed to a degree less than that which provides for seal bending at a location other than predominately at the corner areas thereof under the applied opposing component forces.

5. In a method as defined in claim 4 wherein the inside corners of the preformed seal have a radius of from about 1 to 2 times the thickness of one of the overlying strap portions.

6. In a method as defined in claim 1 wherein the improvement further comprises applying the forces to the seal web and flanges to crimp the seal and the overlying strap portion from each of the opposite longitudinal edges of the seal along at least about $\frac{1}{3}$ of the seal width.

7. In a method as defined in claim 6 wherein the forces are applied to the seal web and flanges to crimp the seal and overlying strap portions along less than $\frac{1}{2}$ of the seal width from each of the opposite longitudinal edges of the seal.

8. In a method as defined in claim 6 wherein the improvement further comprises varying across the width of the seal the forces applied to the web and flanges thereof to provide crimps which are of less depth progressively along the lengths thereof from a maximum depth along the longitudinal edges of the seal.

9. In a method as defined in claim 2 wherein the improvement further comprises applying the forces to the seal web and flanges to crimp the seal and the overlying strap portion from each of the opposite longitudinal edges of the seal along at least about $\frac{1}{3}$ of the seal width.

10. In a method as defined in claim 9 wherein the forces are applied to the seal web and flanges to crimp the seal and overlying strap portions along less than $\frac{1}{2}$ of the seal width from each of the opposite longitudinal edges of the seal.

11. In a method as defined in claim 10 wherein the improvement further comprises varying across the width of the seal the forces applied to the web and flanges thereof to provide crimps which are of less depth progressively along the lengths thereof from a maximum depth along the longitudinal edges of the seal.

12. In a method as defined in claim 11 wherein said seal is formed of electrogalvanized sheet steel and said overlying strap portions are formed of polyester whereby surfaces of said overlying strap portions and seal are bonded to each other during seal application.

* * * * *